US007461945B2

(12) United States Patent
Shiau

(10) Patent No.: US 7,461,945 B2
(45) Date of Patent: Dec. 9, 2008

(54) FOCUS-ADJUSTABLE LED FLASHLIGHT

(76) Inventor: Wen-Chin Shiau, No. 10, Alley 1 Lane 551, Sec. 1, Wan-Shou Rd., Kuei-Shan Hsiang, Tao-Yuan Hsien (TW)

( * ) Notice: Subject to any disclaimer, the term of this patent is extended or adjusted under 35 U.S.C. 154(b) by 0 days.

(21) Appl. No.: 11/634,677

(22) Filed: Dec. 6, 2006

(65) Prior Publication Data

US 2008/0068833 A1 Mar. 20, 2008

(30) Foreign Application Priority Data

Sep. 15, 2006 (TW) ..... 95134204 A

(51) Int. Cl.
*F21L 4/00* (2006.01)

(52) U.S. Cl. ..... 362/187; 362/174

(58) Field of Classification Search ..... 362/187, 362/174, 176, 200, 202, 208, 277, 340, 800
See application file for complete search history.

(56) References Cited

U.S. PATENT DOCUMENTS

| | | | | |
|---|---|---|---|---|
| 1,478,282 | A * | 12/1923 | Hunter | 362/187 |
| 7,083,299 | B2 * | 8/2006 | Chapman | 362/188 |
| 7,147,343 | B2 * | 12/2006 | Chapman | 362/187 |
| 2005/0099805 | A1 * | 5/2005 | Chapman | 362/184 |
| 2005/0254233 | A1 * | 11/2005 | Alessio | 362/169 |

* cited by examiner

*Primary Examiner*—Hargobind S Sawhney
(74) *Attorney, Agent, or Firm*—Kramer Levin Naftalis & Frankel LLP

(57) ABSTRACT

A focus-adjustable LED flashlight includes: a tubular housing; an LED light-emitting unit coupled to the tubular housing; a sleeve unit coupled movably to the tubular housing; and a positive lens mounted in the sleeve unit and spaced apart from and aligned with the LED light-emitting unit along an axis of the tubular housing. The sleeve unit is movable relative to the tubular housing and the LED light-emitting unit along the axis of the tubular housing so as to adjust a distance between the positive lens and the LED light-emitting unit.

5 Claims, 3 Drawing Sheets

FOCUS-ADJUSTABLE LED FLASHLIGHT

CROSS-REFERENCE TO RELATED APPLICATION

This application claims the priority of Taiwanese Application No. 095134204, filed on Sep. 15, 2006.

BACKGROUND OF THE INVENTION

1. Field of the Invention

The invention relates to a focus-adjustable LED flashlight, more particularly to a focus-adjustable LED flashlight including an LED light-emitting unit and a positive lens that is adjustable to move relative to the LED light-emitting unit.

2. Description of the Related Art

In recent years, light-emitting diode (LED) lamps have become popular for use as a light source for a flashlight. However, since the conventional flashlight uses a parabolic reflector for collecting and directing the LED light and since the emitted angle of the LED light is not the same as a point light source, a considerable portion of the LED light cannot be collected and directed by the parabolic reflector. Hence, the intensity of the LED light focused through adjustment of the position of the LED lamp relative to the parabolic reflector is relatively poor.

SUMMARY OF THE INVENTION

Therefore, the object of the present invention is to provide a focus-adjustable LED flashlight that can overcome the aforesaid drawback of the prior art.

Accordingly, a focus-adjustable LED flashlight of this invention comprises: a tubular housing; an LED light-emitting unit coupled to the tubular housing; a sleeve unit coupled movably to the tubular housing; and a positive lens mounted in the sleeve unit and spaced apart from and aligned with the LED light-emitting unit along an axis of the tubular housing. The sleeve unit is movable relative to the tubular housing and the LED light-emitting unit along the axis of the tubular housing so as to adjust a distance between the positive lens and the LED light-emitting unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
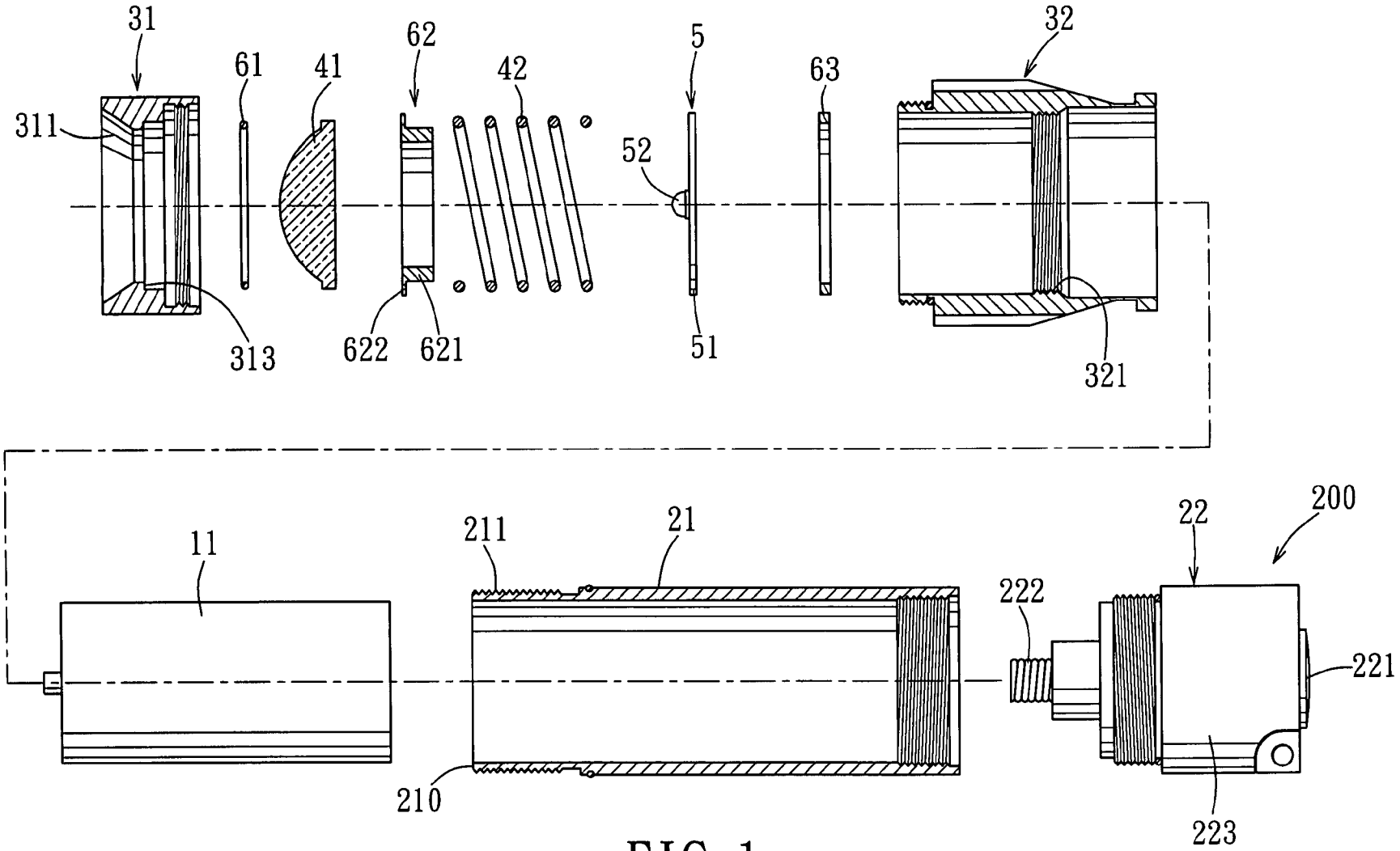
FIG. 1 is an exploded sectional view of the first preferred embodiment of a focus-adjustable LED flashlight according to the present invention.

Before the present invention is described in greater detail with reference to the accompanying preferred embodiments, it should be noted herein that like elements are denoted by the same reference numerals throughout the disclosure.

Figure 2:
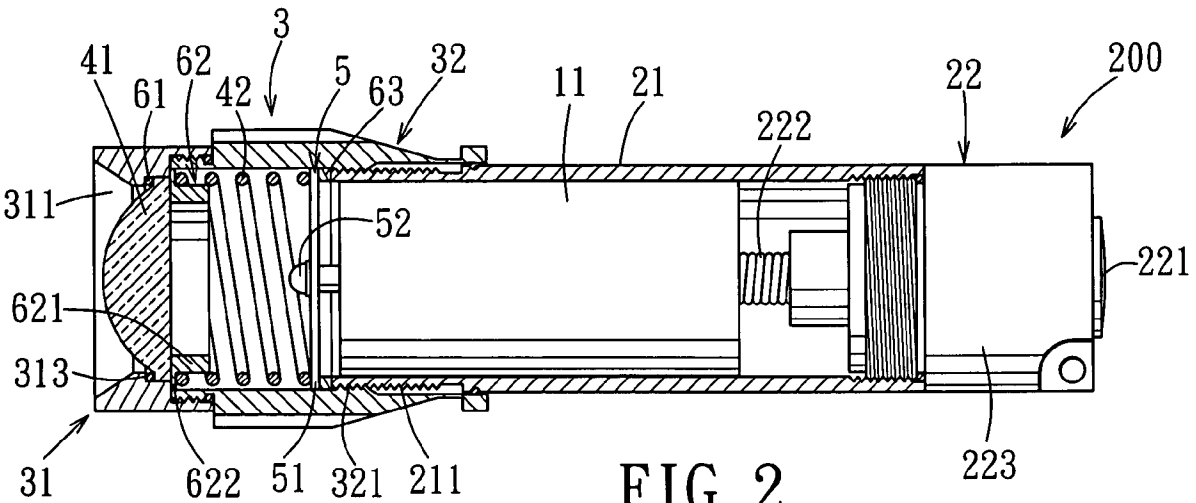
FIG. 2 is an assembled sectional view of the first preferred embodiment.

Referring to FIGS. 1 and 2, the first preferred embodiment of a focus-adjustable LED flashlight 200 according to the present invention is shown to comprise: a tubular housing 21; an LED light-emitting unit 5 coupled to the tubular housing 21; a sleeve unit 3 coupled movably to the tubular housing 21; and a positive lens 41 mounted in the sleeve unit 3 and spaced apart from and aligned with the LED light-emitting unit 5 along an axis of the tubular housing 21. The sleeve unit 3 is movable relative to the tubular housing 21 and the LED light-emitting unit 5 along the axis of the tubular housing 21 so as to adjust a distance between the positive lens 41 and the LED light-emitting unit 5.

The focus-adjustable LED flashlight 200 is adapted for receiving a battery unit therein. In this embodiment, the battery unit includes a battery 11. However, the battery unit may include a plurality of batteries 11 according to actual requirements.

The positive lens 41 can be a plano-convex or a biconvex lens, and is preferably a plano-convex lens.

The tubular housing 21 has an end face 210. The LED light-emitting unit 5 includes a circuit board 51. The sleeve unit 3 includes a first sleeve 32 engaging threadedly the tubular housing 21, a second sleeve 31 engaging threadedly the first sleeve 32, and an urging member 42. The circuit board 51 is urged by the urging member 42 toward the end face 210 of the tubular housing 21 to press against a first O-ring 63. The positive lens 41 covers a front opening 311 of the second sleeve 31. The second sleeve 31 is formed with an inner shoulder 313 such that, when the positive lens 41 is disposed in the second sleeve 31, the positive lens 41 is urged by the urging member 42 toward the inner shoulder 313 to press against a second O-ring 61 for positioning purposes.

The LED light-emitting unit 5 further includes an LED 52 mounted on the circuit board 51 and facing the positive lens 41.

The sleeve unit 3 further includes an abutting member 62 that has a ring portion 621 and a flange portion 622 extending radially from the ring portion 621 and urged by the urging member 42 toward the inner shoulder 313 to abut against the positive lens 41. In this embodiment, the urging member 42 is in the form of a compression spring that is sleeved on the ring portion 621.

The tubular housing 21 is formed with an outer thread 211. The first sleeve 31 is formed with an inner thread 321 for engaging threadedly the outer thread 211. The inner thread 321 has an axial length less than that of the outer thread 211.

The focus-adjustable LED flashlight 200 further includes an enclosure unit 22 operable to be mounted on a rear end of the tubular housing 21. The enclosure unit includes an enclosure body 223, a switch 221 mounted at a rear end of the enclosure body 223, and a spring 222 mounted at a front end of the enclosure body 223 for biasing the battery unit toward the circuit board 51 of the LED light-emitting unit 5.

Figure 3:
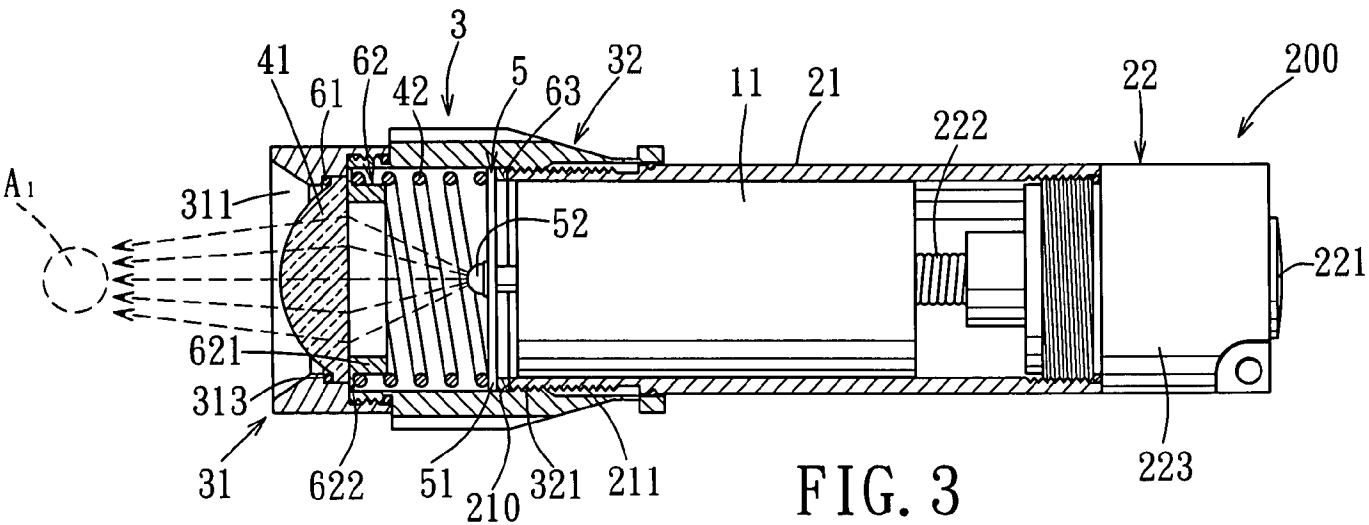
FIG. 3 is a sectional view of the first preferred embodiment in a state of use where the light rays emitted from an LED light-emitting unit are focused toward an object.
Figure 4:
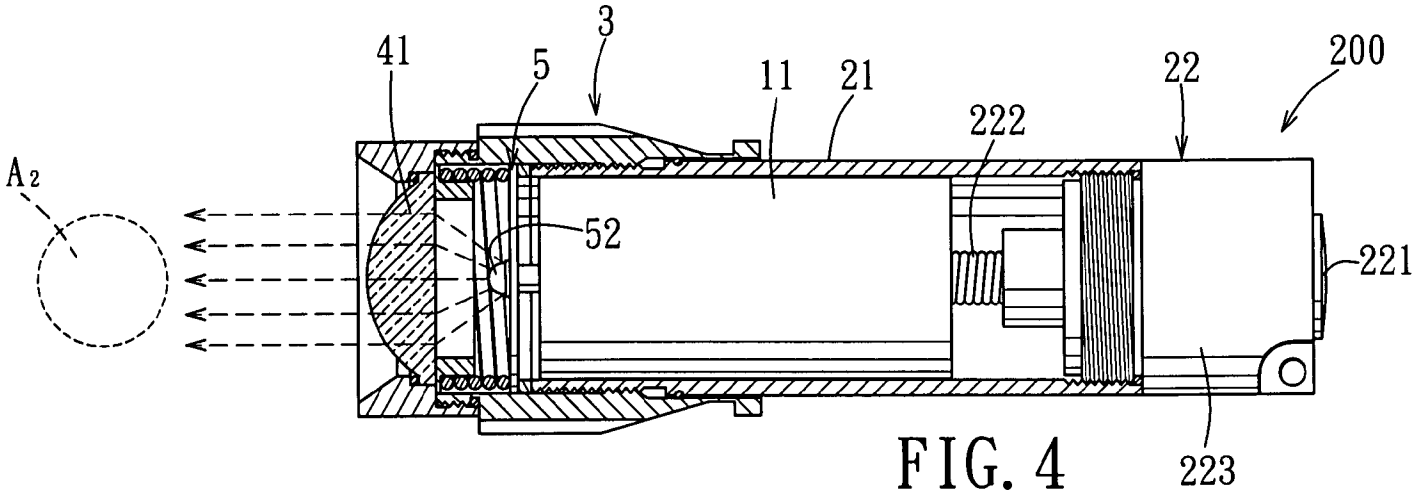
FIG. 4 is a sectional view of the first preferred embodiment in another state of use where the light rays emitted from the LED light-emitting unit are collimated.

FIG. 3 illustrates a state of use where the light rays emitted from the LED light-emitting unit 5 are focused toward an object (A1). Referring to FIG. 4, when it is desired to cast a parallel light beam toward an object (A2), the sleeve unit 3 is threadedly rotated to move axially relative to the tubular housing 21 such that the positive lens 41 is moved toward the LED light-emitting unit 5, thereby permitting the light rays emitted from the LED light-emitting unit 5 toward the object (A2) to be collimated.

Figure 5:
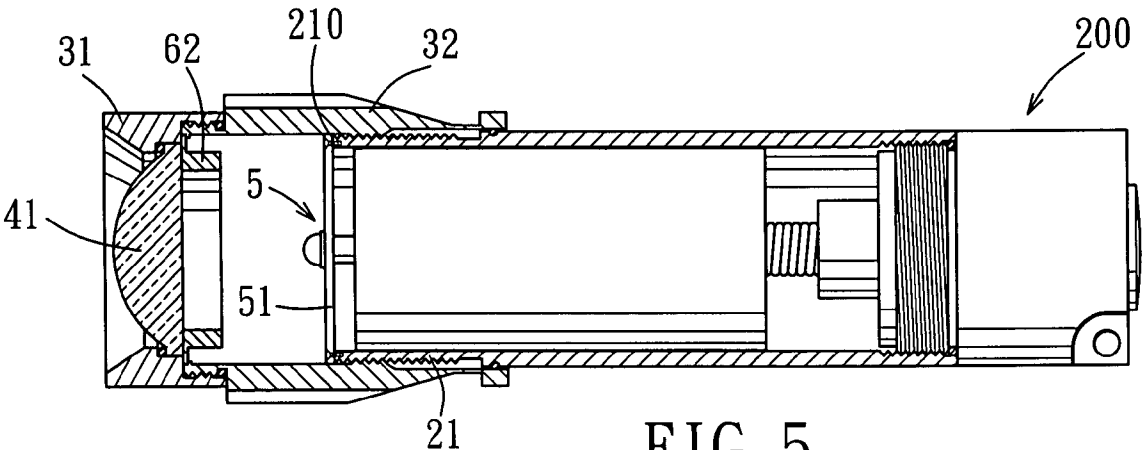
FIG. 5 is an assembled sectional view of the second preferred embodiment of a focus-adjustable LED flashlight according to the present invention.

Referring to FIG. 5, the second preferred embodiment of the focus-adjustable LED flashlight 200 according to this invention differs from the first preferred embodiment in that the circuit board 51 is fastened to the end face 210 of the tubular housing 21 through screw means. The positive lens 41 is mounted securely in the second sleeve 31, and abuts against the abutting member 62 through pressing action of the first sleeve 32 against the abutting member 62 when the first sleeve 32 is threadedly tightened on the second sleeve 31.

With the inclusion of the positive lens 41 and the sleeve unit 3 in the focus-adjustable LED flashlight of this invention, the aforesaid drawback associated with the prior art can be eliminated.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A focus-adjustable LED flashlight comprising:

a tubular housing;

an LED light-emitting unit coupled to said tubular housing;

a sleeve unit coupled movably to said tubular housing; and a positive lens mounted in said sleeve unit and spaced apart from and aligned with said LED light-emitting unit along an axis of said tubular housing;

wherein said sleeve unit is movable relative to said tubular housing and said LED light-emitting unit along the axis of said tubular housing so as to adjust a distance between said positive lens and said LED light-emitting unit; and wherein said tubular housing has an end face, said LED light-emitting unit including a circuit board, said sleeve unit including a first sleeve engaging threadedly said tubular housing, a second sleeve engaging threadedly said first sleeve, and an urging member, said circuit board being urged by said urging member toward said end face of said tubular housing, said second sleeve being formed with an inner shoulder, said positive lens being disposed in said second sleeve and being urged by said urging member towards said inner shoulder.

2. The focus-adjustable LED flashlight as claimed in claim 1, wherein said positive lens is a plano-convex lens.

3. The focus-adjustable LED flashlight as claimed in claim 2, wherein said LED light-emitting unit further includes an LED mounted on said circuit board.

4. The focus-adjustable LED flashlight as claimed in claim 1, wherein said sleeve unit further includes an abutting member that has a ring portion and a flange portion extending radially from said ring portion and urged by said urging member to abut against said positive lens, said urging member being in the form of a compression spring that is sleeved on said ring portion.

5. The focus-adjustable LED flashlight as claimed in claim 1, wherein said tubular housing is formed with an outer thread, said first sleeve being formed with an inner thread for engaging threadedly said outer thread, said inner thread having an axial length less than that of said outer thread.

* * * * *